US006003404A

United States Patent [19]

Hannewald

[11] Patent Number: 6,003,404

[45] Date of Patent: Dec. 21, 1999

[54] ACCELERATOR PEDAL ASSEMBLY FOR CONTROLLING THE POWER OF AN INTERNAL COMBUSTION ENGINE

[75] Inventor: Thomas Hannewald, Griesheim, Germany

[73] Assignee: VDO Adolf Schindling AG, Frankfurt, Germany

[21] Appl. No.: 09/022,254

[22] Filed: Feb. 11, 1998

Related U.S. Application Data

[63] Continuation of application No. 08/625,172, Mar. 29, 1996, abandoned.

[30] Foreign Application Priority Data

Oct. 5, 1995 [DE] Germany ..... 195 17 172

[51] Int. Cl.[6] ..... G05G 1/14

[52] U.S. Cl. ..... 74/512; 74/513; 74/560

[58] Field of Search ..... 74/512, 560, 513, 74/514, 523, 533, 535; 403/79, 167

[56] References Cited

U.S. PATENT DOCUMENTS

| | | | |
|---|---|---|---|
| 4,297,550 | 10/1981 | Leighton | 74/512 X |
| 5,078,024 | 1/1992 | Cicotte et al. | 74/512 |
| 5,385,068 | 1/1995 | White et al. | 74/513 X |
| 5,551,317 | 9/1996 | Gautier et al. | 74/560 |
| 5,865,067 | 2/1999 | Knapp | 74/512 |
| 5,868,039 | 2/1999 | Baumann | 74/512 |

FOREIGN PATENT DOCUMENTS

| | | | |
|---|---|---|---|
| 41 12 133 | 10/1991 | Germany | 74/512 |

*Primary Examiner*—Vinh T. Luong
*Attorney, Agent, or Firm*—Martin A. Farber

[57] ABSTRACT

An accelerator pedal, for controlling the power of an internal combustion engine, has a pedal lever which is acted on manually by force on an outer end region, and is swingably mounted on an inner end region around a swing shaft within a bearing housing. The inner end region of the pedal lever extends through an opening into the bearing housing, and is located on the shaft. The bearing housing is developed in two or more parts. The ends of the shaft are arranged on different ones of the housing parts to provide a jam-free mounting of the pedal lever. A spring-load brake contacts the inner region of the pedal lever within the housing.

31 Claims, 4 Drawing Sheets

ACCELERATOR PEDAL ASSEMBLY FOR CONTROLLING THE POWER OF AN INTERNAL COMBUSTION ENGINE

RELATED APPLICATION

This application is a continuation of my application Ser. No. 08/625,172 filed Mar. 29, 1996, now abandoned which is incorporated herein by reference.

FIELD AND BACKGROUND OF THE INVENTION

The present invention relates to an accelerator pedal assembly for controlling the power of an internal combustion engine, the lever of which pedal can be acted on by manual force at the region of its one end, and is mounted for swinging around a swivel axis at the region of its other end.

Accelerator pedals are known in which the swingably mounted end region of the pedal lever is arranged in a bearing bracket, fixed against rotation on a shaft the ends of which are rotatably supported in a flanged sleeve. Pedal levers of plastic furthermore have a metal tube between the shaft and the pedal lever in order to create an attachment which is reliably fixed against rotation. A wiper of a potentiometer can be swingably driven via the shaft, the potentiometer and wiper being arranged in a separate chamber which can be closed by a cover. A lever which acts on a friction brake is swingably mounted on an additional shaft which is arranged on the bearing bracket.

Such accelerator pedal assemblies are of complicated construction and require a large expenditure for parts and assembly. After the assembling of the accelerator pedal, the shaft must be pressed into the pedal lever, while the arrangement of the potentiometer on the shaft in a separate chamber requires a large amount of space.

Since the flanged sleeves for the supporting of the shaft are contained in the bearing bracket, there is the danger, in the case of a plastic bearing bracket, that the pedal lever will get jammed due to elastic deformations of the bearing bracket.

SUMMARY OF THE INVENTION

It is an object of the invention to create an accelerator pedal of the aforementioned type in which an easily movable, jam-free supporting of a pedal lever is obtained at a favorable cost in a space-saving manner and with only a small number of simple parts as well as a small expense for mounting.

According to the invention, the swingably mounted end region (28) of the pedal lever (2) extends through an opening (17) into a bearing housing and is arranged on a shaft (1), the bearing housing being developed in several parts, and the ends of the shaft (1) being arranged on different housing parts.

The arrangement of the swingably mounted end region of the pedal lever within the multipartite bearing housing has the advantage of a space-saving construction, the swingably mounted end region of the pedal lever together with the shaft being adapted to be mounted in simple manner within the bearing housing by a bringing together of the different housing parts.

In this connection, the bearing place of the pedal lever is formed between the swingably supported end region of the pedal lever and the shaft, as a result of which a rotatable mounting of the ends of the shaft is dispensed with and thus, particularly in the case of an elastically deformable bearing housing, an easily moving, jam-free mounting is assured.

The bearing housing may advantageously be developed in two parts and consist of a cup-shaped housing part (3) and a cover part (4).

This has the advantage that upon a mounting of the accelerator pedal, the swingably supported end region of the pedal lever and the shaft can be introduced through the open end of the cup-shaped housing part and, after fixing in position by a placing of the cover part on the housing part, can be brought into the assembled position.

In this case, one end of the shaft is arranged on the bottom of the housing part (3) and the other end on the cover part (4).

It is particularly advantageous if each end of the shaft (1) is arranged in a recess (5, 6) in the housing parts. In this case, the shaft is dependably fixed in position if the recesses in the housing parts have correspondingly suitable tolerances with respect to the ends of the shaft.

The shaft (1) is arranged fixed against rotation in the manner that the ends of the shaft are connected, preferably by form lock, to the housing parts. In this way, undesired radial or axial movements of the shaft and thus disturbing relative movements between the shaft and the pedal lever which lead to a jamming are avoided.

The shaft (1) is arranged fixed against rotation by form lock on the bearing housing.

The shaft (1) is advantageously arranged fixed against rotation by a steplike stop (7) on at least one housing part. This stop makes possible, in an easy manner and at a low manufacturing expense, a form-locked attachment which can also be loosened rapidly in case of need.

The shaft (1) extends parallel to a fixed attachment plane of the bearing housing, whereby a suitable actuating of the pedal lever is assured.

The swingably mounted end region (28) of the pedal lever (2) is arranged swingable on the shaft (1). This has the advantage that the supporting of the pedal lever is effected reliably and jam-free despite elastic deformations of the bearing housing, since the shaft is arranged fixed against rotation within the bearing housing and the arrangement of the pedal lever on the shaft forms a closed bearing place.

The swingably supported end region (28) of the pedal lever (2) has a recess (8) within which a bearing bushing (9) for the supporting of the shaft (1) is arranged, fixed against rotation.

The arrangement of the bearing bushing assures a sliding support of the swingably mounted end region of the pedal lever on the shaft, in which connection the material of the bearing bushing has good sliding properties.

The swingably mounted end region of the pedal lever (2) has a small amount of axial play with respect to the housing parts.

Due to the stopped arrangement of the shaft within the bearing housing, the ends of the shaft are also fixed in axial direction, so that the axial play of the swingably mounted end region of the pedal lever with respect to the housing parts is controllable and can be reduced to a minimum.

The regions of the housing parts which receive the ends of the shaft (1) have ring-shaped portions (10, 11) which are directed towards each other.

This has the advantage that, on the one hand, recesses in the housing parts assure a dependable reception of the ends of the shaft with respect to stability and, on the other hand, further parts which are to be arranged within the bearing housing can be received by these ring-shaped portions.

Thus, a wiper path of a potentiometer can be arranged, fixed against rotation, on one of the ring-shaped portions (10, 11) in the regions of the housing parts which receive the ends of the shaft.

On the swingably mounted end region of the pedal lever (2) and advantageously, in a recess (12) in said end region, a wiper (14) of the potentiometer is arranged, fixed against rotation.

By the arrangement of the potentiometer within the bearing housing a considerable amount of structural space is saved.

The housing part (3) can advisedly be fastened to the cover part by form lock or else detachably by fastening elements, as a result of which the accelerator pedal is in the assembled state.

It is particularly advantageous if the housing part (3) is attached to the cover part (4) by a detent engagement (15).

The bearing housing can be fastened in its fixed attachment plane by attachment elements (16) in a region of the housing part (3) and a region which connects the housing part (3) with the cover part (4).

By the fastening in the region connecting the housing part with the cover part, the attachment of the housing parts is further stabilized.

The opening (17) in the bearing housing is advantageously provided with a labyrinth-like seal (18) which seals from the swingably mounted end region of the pedal lever (2). In this way, the bearing housing is substantially closed and protected against dirt and other external influences.

The swingably mounted end region of the pedal lever (2) is provided with a lever arm (19) which is acted on by a return spring (20) which rests on a second lever (21) which is swingable around a shaft which is parallel to the axis of swing of the pedal lever (2).

A friction brake (22) can be acted on by the lever (21), the pedal lever (2) being swingable against the brake force of the brake. In this connection the arrangement of the lever in space-saving manner within the bearing housing is advantageous.

The lever (21) is provided with a depression (23) in which the lever (2) can swing around an extension (24) which protrudes from the inner wall of the bearing housing. In this way, an additional shaft around which the lever is swingable can be dispensed with.

In order to obtain certain functions, a brake surface (26) which is attached fixed against rotation to the pedal lever (2) can be acted on with force by a lever arm (25) of the lever (21).

BRIEF DESCRIPTION OF THE DRAWINGS

With the above and other objects and advantages in view, the present invention will become more clearly understood in connection with the detailed description of preferred embodiments, when considered with the accompanying drawing, of which.

DETAILED DESCRIPTION OF THE PREFERRED EMBODIMENTS

Figure 1:
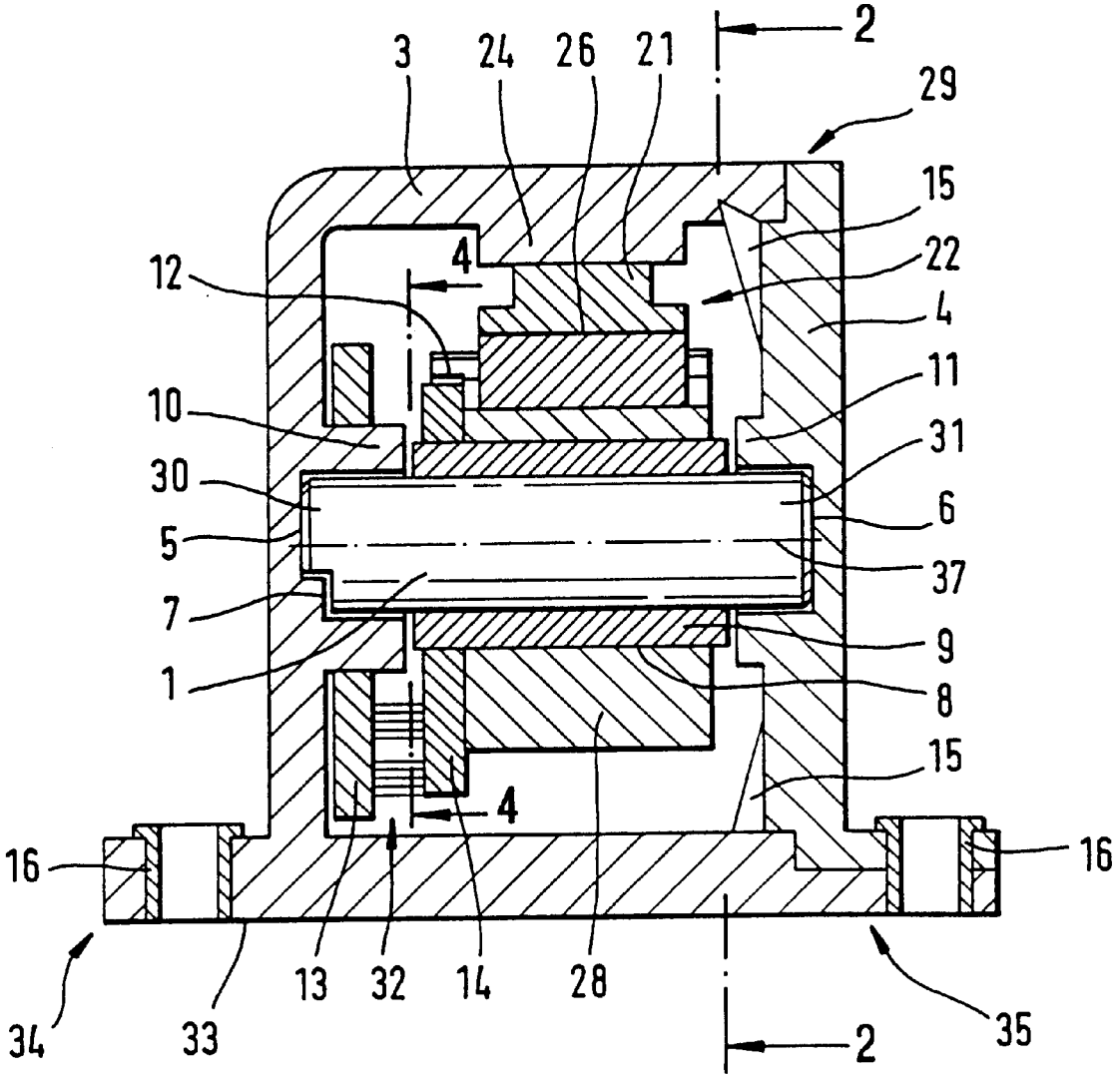
FIG. 1 is a section through a bearing housing of an accelerator pedal lever taken along the line 1—1 in FIG. 2.

FIG. 1 shows a accelerator pedal lever 2 which is mounted at the region 28 of one of its ends for swinging around a shaft (axle) 1, the pedal lever 2 extending into a bearing housing 29 consisting of a cup-shaped housing part 3 and a cover part 4.

Figure 2:
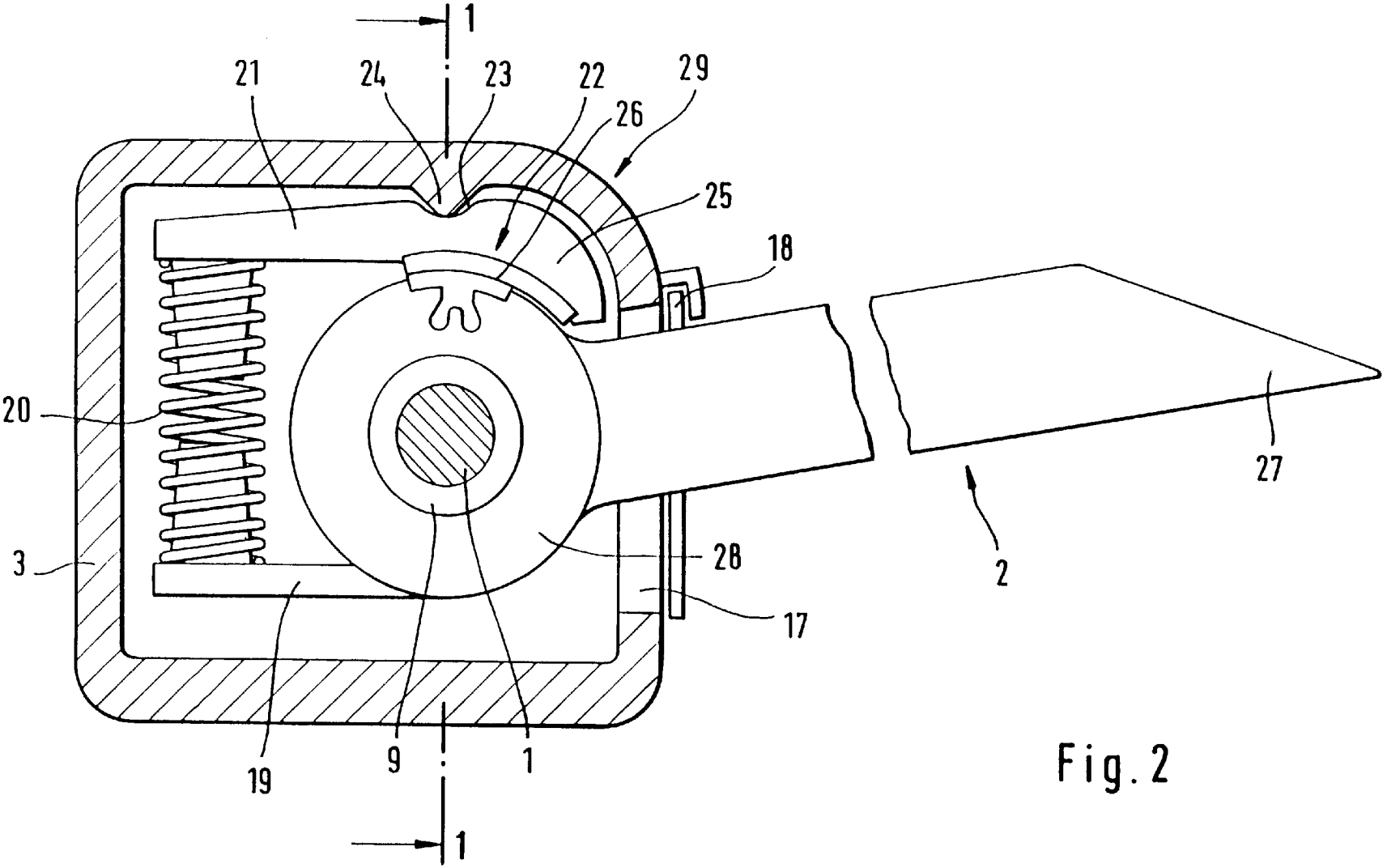
FIG. 2 shows, in stylized fashion, a section through a side view of the bearing housing taken along the line 2—2 in FIG. 1.

The pedal lever 2 can be acted on by the force of the foot of the driver on a first end region 27 of the lever 2, shown in FIG. 2.

Figure 4:
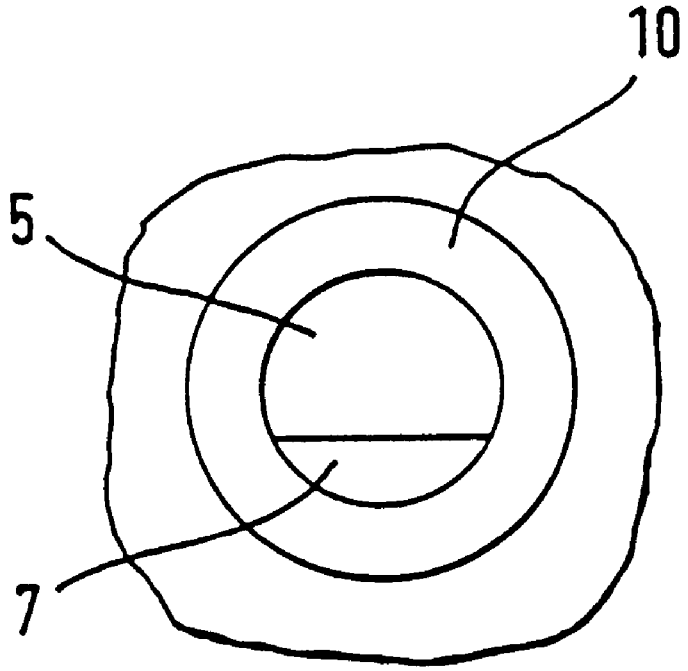
FIG. 4 is a sectional view taken along the line 4—4 in FIG. 1, and shows a stop in the form of a step extending transversely of a fixed shaft for the pedal lever.

A first end 30 of the shaft 1 is arranged in form-locking manner in a first recess 5 in the bottom of the housing part 3, while its second end 31 is arranged in a second recess 6 in the cover part 4. At the recess 5, the shaft 1 is fixed against rotation by a steplike stop 7 (FIGS. 1 and 4) extending transversely of the shaft 1 in the recess 5. The shaft 1 is thereby fixed by the stop 7 in radial and in axial direction to serve as a non-rotating axle about which the pedal 2 can pivot.

For a suitable actuating of the pedal lever 2, the shaft 1 extends parallel to a fixed attachment plane 33 of the bearing housing 29. The swingably mounted second end region 28 of the pedal lever 2 has a recess 8 in which a bearing bushing 9 for the supporting of the shaft 1 is arranged, fixed against rotation for swingably mounting the second end region 28 of the pedal lever 2 on the shaft 1.

The regions of the housing part 3 and of the cover part 4 which receive the ends of the shaft 1 have ring-shaped portions 10, 11 directed towards each other, with respect to which the swingably mounted end region 28 of the pedal lever 2 has a slight axial clearance.

The swingably mounted end region 28 of the pedal lever 2 is advantageously provided with a recess 12 within which there is arranged, fixed against rotation, a wiper 14 of a potentiometer 32 (FIG. 1) having a wiper track 13 which is arranged, fixed against rotation, on the ring-shaped portion 10.

The housing part 3 is detachably connected to the cover part 4 by a detent attachment 15, the bearing housing 29 being adapted to be fastened in its fixed attachment plane 33 by attachment elements 16 in a region 34 (FIG. 1) of the housing part 3 and a region 35 connecting the housing part 3 to the cover part 4. As is well known in the construction of a detent, one element presses into a slight depression of a second element to produce a retention force which retains the two elements in their respective positions. To simplify FIG. 1, detent 15 at the bottom of the figure is shown without a depression in housing part 3 while, at the top of the figure, detent 15 is shown with an exaggerated depression in the housing part 3.

As can be noted from FIG. 2, the swingably mounted end region 28 of the pedal lever 2 extends through an opening 17 into the bearing housing 29, the opening 17 being provided with a labyrinth-like seal 18, or labyrinth packing, sealing off the bearing housing 29 from the swingably mounted end region 28 of the pedal lever 2.

Figure 3:
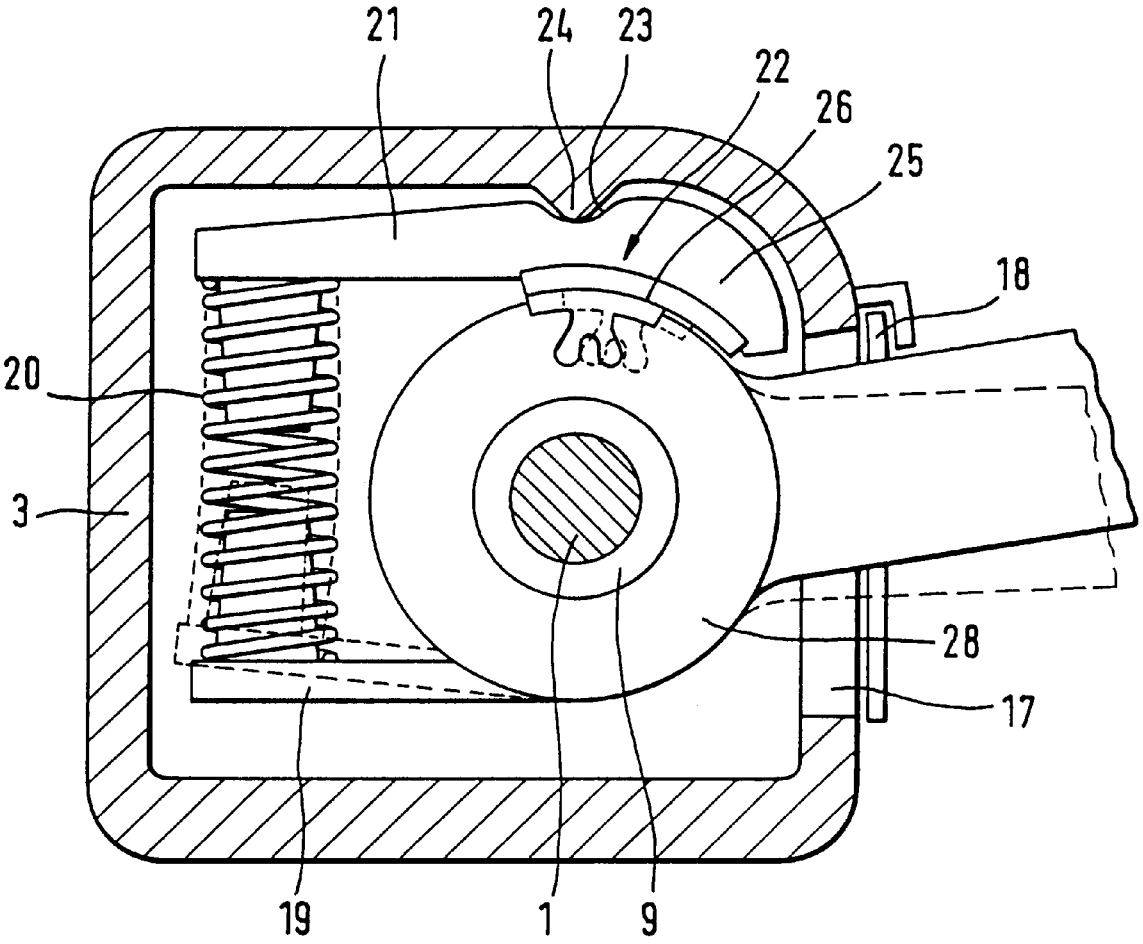
FIG. 3 shows movement of the pedal lever and a spring.

The swingably mounted end region 28 of the pedal lever 2 is provided with a lever arm 19 (FIG. 2) which is acted on by a return spring 20 which rests on a second lever 21 which is swingable about an extension 24 serving as a second shaft or pivot means (FIG. 3) parallel to the axis 37 (FIG. 1) of swing of the pedal lever 2. The extension 24 may have any length suitable for the swinging of the lever 21, the length in FIG. 1 being shown by way of example.

A friction brake 22 is acted upon by the lever 21, against a braking force of which brake the pedal lever 2 is swingable.

The lever 21 is provided with a depression 23 in which the lever 21 is swingable around the extension 24 which extends out from the inner wall of the housing part 3. In this way, an additional shaft around which the lever 21 is swingable can be dispensed with.

A brake surface 26 which is connected fixed against rotation to the pedal lever 2 can be acted on with force by a lever arm 25 of the lever 21.

I claim:

1. An accelerator pedal assembly, suitable for controlling power of an internal combustion engine, the assembly having a pivot axis and a pedal lever pivotal about said axis, wherein the pedal lever is actuatable by manual force at a first end region of the lever and is mounted for swinging around the pivot axis at a second end region of the lever opposite the first end region;

wherein the assembly further comprises a bearing housing having an opening and comprising two different housing parts, and an axle coaxial to said pivot axis and disposed in the housing and having first and second opposed ends; and said second end region of the pedal lever extends through said opening into said bearing housing and is located on said axle, the first and the second ends of said axle being supported respectively in a first and in a second of the two housing parts.

2. A pedal assembly according to claim 1, wherein said bearing housing consists of said two parts.

3. A pedal assembly according to claim 1, wherein one of said two housing parts is a cup-shaped housing part and the other of said housing parts is a cover part.

4. A pedal assembly according to claim 3, wherein said first end of said axle is located in said cup-shaped housing part, and said second end of said axle is located in said cover part.

5. A pedal assembly according to claim 3, wherein said first and said second housing parts are fastened to each other by form lock.

6. A pedal assembly according to claim 3, further comprising:

a fastening element for fastening said first housing part to said second housing part.

7. A pedal assembly according to claim 3, wherein said first housing part is attached to said second housing part by a detent attachment.

8. A pedal assembly according to claim 3, wherein said bearing housing further comprises attachment elements at a fixed attachment plane of said first housing part, one of said attachment elements being adjacent a connection between said first and said second housing parts.

9. A pedal assembly according to claim 1, wherein at least one of said housing parts holds said axle fixed against rotation.

10. A pedal assembly according to claim 1, wherein said bearing housing includes means for holding said axle fixed against rotation by form lock between said axle and said housing.

11. A pedal assembly according to claim 10, wherein said holding means comprises a stepped stop on at least one of said housing parts for fixing said axle against rotation.

12. A pedal assembly according to claim 1, wherein there is a fixed attachment plane in said bearing housing and said axle extends parallel to the fixed attachment plane of said bearing housing.

13. A pedal assembly according to claim 1, further comprising mounting means for swingably supporting said second end region of the pedal lever on said axle.

14. A pedal assembly according to claim 13, wherein said second end region of said pedal lever has an axial play with respect to said housing.

15. A pedal assembly according to claim 1, further comprising a labyrinth packing located in said opening of the bearing housing for sealing said second end of said pedal lever.

16. An accelerator pedal assembly, suitable for controlling power of an internal combustion engine, the assembly having a pivot axis and a pedal lever pivotal about said axis, wherein the pedal lever is actuatable by manual force at a first end region of the lever and is mounted for swinging around the pivot axis at a second end region of the lever opposite the first region;

wherein the assembly further comprises a bearing housing having an opening and comprising a plurality of housing parts, and an axle coaxial to said pivot axis and disposed in the housing and having first and second ends;

said second end region of the pedal lever extends through said opening into said bearing housing and is located on said axle, the first and the second ends of said axle being disposed respectively in different ones of said housing parts;

a first of said housing parts is a cup-shaped housing part and a second of said housing parts is a cover part;

said first end of said axle is located in said cup-shaped housing part, and said second end of said axle is located in said cover part; and said first housing part has a first recess for receiving said first end of said axle, and said second housing part has a second recess for receiving said second end of said axle.

17. A pedal assembly according to claim 16, wherein said first and said second recesses have respective ring-shaped portions which are directed towards each other.

18. A pedal assembly according to claim 16, further comprising:

a potentiometer disposed in said housing, said potentiometer having a wiper;

mounting means for swingably supporting said second end region of the pedal lever on said axle; and wherein said wiper of the potentiometer is arranged, fixed against rotation on said second end region of the pedal lever.

19. A pedal assembly according to claim 18, wherein the wiper of the potentiometer is arranged nonrotatably in said first recess.

20. A pedal assembly according to claim 19, wherein a track of said wiper of the potentiometer is arranged fixed against rotation on one of said housing parts.

21. A pedal assembly according to claim 20, wherein said first and said second recesses have respective ring-shaped portions which are directed towards each other; and wherein the wiper track of said potentiometer is arranged, fixed against rotation, on one of said ring-shaped portions.

22. An accelerator pedal assembly, suitable for controlling power of an internal combustion engine, the assembly having a pivot axis and a pedal lever pivotal about said axis, wherein the pedal lever is actuatable by manual force at a first end region of the lever and is mounted for swinging around the pivot axis at a second end region of the lever opposite the first end region;

wherein the assembly further comprises a bearing housing having an opening and comprising two different housing parts, and an axle coaxial to said pivot axis and disposed in the housing and having first and second opposed ends;

said second end region of the pedal lever extends through said opening into said bearing housing and is located on said axle, the first and the second ends of said axle being supported respectively in a first and in a second of the two housing parts;

at least one of said housing parts holds said axle fixed against rotation;

said pedal assembly further comprises a bearing bushing encircling said axle; and wherein a second end region of said pedal lever has a recess for receiving said bearing bushing.

23. An accelerator pedal assembly, suitable for controlling power of an internal combustion engine, the assembly having a pivot axis and a pedal lever pivotal about said axis, wherein the pedal lever is actuatable by manual force at a first end region of the lever and is mounted for swinging around the pivot axis at a second end region of the lever opposite the first end region;

wherein the assembly further comprises a bearing housing having an opening and comprising two different housing parts, and an axle coaxial to said pivot axis and disposed in the housing and having first and second opposed ends;

said second end region of the pedal lever extends through said opening into said bearing housing and is located on said axle, the first and the second ends of said axle being supported respectively in a first and in a second of the two housing parts; and said pedal assembly further comprises a return spring located at said second end region of said pedal lever for acting on a lever arm of said pedal lever.

24. An accelerator pedal assembly, suitable for controlling power of an internal combustion engine, the assembly having a pivot axis and a pedal lever pivotal about said axis, wherein the pedal lever is actuatable by manual force at a first end region of the lever and is mounted for swinging around the pivot axis at a second end region of the lever opposite the first end region;

wherein the assembly further comprises a bearing housing having an opening and comprising a plurality of housing parts, and an axle coaxial to said pivot axis and disposed in the housing and having first and second ends;

said second end region of the pedal lever extends through said opening into said bearing housing and is located on said axle, the first and the second ends of said axle being disposed respectively in different ones of said housing parts;

said pedal assembly further comprises a return spring located at said second end region of said pedal lever for acting on a lever arm of said pedal lever;

wherein said spring has a first end contacting said pedal lever, and a second end opposite said first end;

said pedal assembly further comprises a second lever interconnecting the second end of said spring with said second end region of said pedal lever;

a shaft means spaced apart from said axle and contacting said second lever; and wherein the return spring rests on said second lever which is swingable around said shaft means, said shaft means being parallel to said pivot axis.

25. A pedal assembly according to claim 24, further comprising a friction brake which is urged by said second lever against said second end region of said pedal lever, said pedal lever being swingable against a brake force of said brake.

26. A pedal assembly according to claim 25, wherein said second lever has a depression for receiving said shaft means, said shaft means being an extension which protrudes from an inner wall of the bearing housing.

27. A pedal assembly according to claim 26, wherein a brake surface of said brake is attached fixed against rotation to said pedal lever, and is actuatable with force by an arm of said second lever.

28. A pedal assembly according to claim 27, further comprising a stop located at one of said recesses, said stop extending into said axle to inhibit rotation of said axle.

29. A pedal assembly according to claim 27, further comprising a potentiometer having a first part located within said housing and fixed to said housing at the location of either one of said first and said second recesses, said potentiometer further comprising a wiper part located within said housing and movable relative to said first part and being driven by said pedal lever.

30. A pedal assembly, suitable for controlling power of an internal combustion engine, comprising:

a pedal lever, and a housing having an opening for receipt of said pedal lever, said housing comprising a first housing part and a second housing part;

an axle having first and second opposed ends, said axle being disposed in said housing and extending from said first housing part to said second housing part, said first and said second ends of said axle being disposed respectively in different ones of said housing parts, said first housing part having a first recess for receiving said first end of said axle upon assembly of said first housing part to said second housing part, said second housing part having a second recess for receiving said second end of said axle upon assembly of said first housing part to said second housing part, and said pedal lever extending through said opening for engagement with said axle; and a bearing disposed on said axle between said first recess and said second recess for enabling said pedal lever to pivot about said axle.

31. A pedal assembly according to claim 30, further comprising a potentiometer having a first part located within said housing and fixed to said housing at the location of either one of said first and said second recesses, said potentiometer further comprising a wiper part located within said housing and movable relative to said first part and being driven by said pedal lever.

* * * * *